US005838639A

United States Patent [19]

Hwang

[11] Patent Number: 5,838,639

[45] Date of Patent: Nov. 17, 1998

[54] WATCH HAVING LASER POINTER

[76] Inventor: Hsien-Jung Hwang, 4F, No. 10, Alley 5, Lane 268, Futeh St., Hsin-Yi District, Taipei, Taiwan

[21] Appl. No.: 881,197

[22] Filed: Jun. 24, 1997

[51] Int. Cl.[6] ..... G04B 47/00

[52] U.S. Cl. ..... 368/10; 368/227

[58] Field of Search ..... 368/10, 227, 327

[56] References Cited

U.S. PATENT DOCUMENTS 4,972,394 11/1990 DiMarco ..... 368/227

5,548,565 8/1996 Aoyama et al. ..... 368/10

*Primary Examiner*—Bernard Roskoski

*Attorney, Agent, or Firm*—Beveridge, DeGrandi, Weilacher & Young LLP

[57] ABSTRACT

The present invention relates to a watch having laser pointer of the type which comprises a housing, a modulating core, a laser diode module, and a power supply. The housing is provided with a clear cover and a display is disposed thereunder. A modulating core is disposed under the display. The power supply is disposed under the modulating core and the diode modulate is disposed in the peripheral of the housing. The laser diode module is provided with a button switch which is used to switch on/off the laser diode module. The emitted laser beam is further intensified by a convex lens and this intensified beam is directed through a aperture of the housing. This intensified light beam can be used to mark the graphic or character on the screen for clear demonstration. On the other hand, the water may still be used as a timing tool.

3 Claims, 5 Drawing Sheets

WATCH HAVING LASER POINTER

FIELD OF THE INVENTION

The present invention relates to a watch, more particularly, to a watch having a laser pointer. The watch is provided with a laser diode module which is disposed at the peripheral of the watch. The laser diode module can be readily switched on for marking pointer or switched off when not in use. When the laser diode is not in use, it can be used as a normal watch.

DESCRIPTION OF PRIOR ART

The existing laser marking pointer is used by the teacher as the laser marking pointer may readily emit a light beam to highlight the emphasized portion. The existing laser marking pointer is built-in a pen or a key ring. As a result, this pen or key ring type laser pointer shall be carefully carried or stored to prevent from losing or forgetting to bring about. As a matter of fact, the laser marking pointer plays an important role in demonstrating or presentation. If this laser pointer is forgotten to bring about, the overall demonstrating effect will be degraded.

SUMMARY OF THE INVENTION

It is the objective of this invention to provide a watch having a laser marking pointer thereof. According to one aspect of the present invention, the laser marking pointer is suitably built-in a watch and which can be readily switched on for marking pointer or switched off when not in use. Most important, this laser marking pointer is carried by the user all around. It features a handy, compact configuration.

According to one preferred embodiment of the present invention, the laser diode module can be suitably disposed on the watchband or disposed within the housing of the watch. The laser marking pointer can be readily used when needed.

According to another aspect of the present invention, the laser diode module is disposed at the peripheral of the watch. On the other hand, the laser diode module and the modulating core can be directly disposed within the housing or the laser diode module can be directly disposed onto the watchband. The housing is provided with a power supply which supplies the power required for the normal operation of the modulating core and the laser diode module. By this arrangement, a compact and convenient watch having laser diode module is provided.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
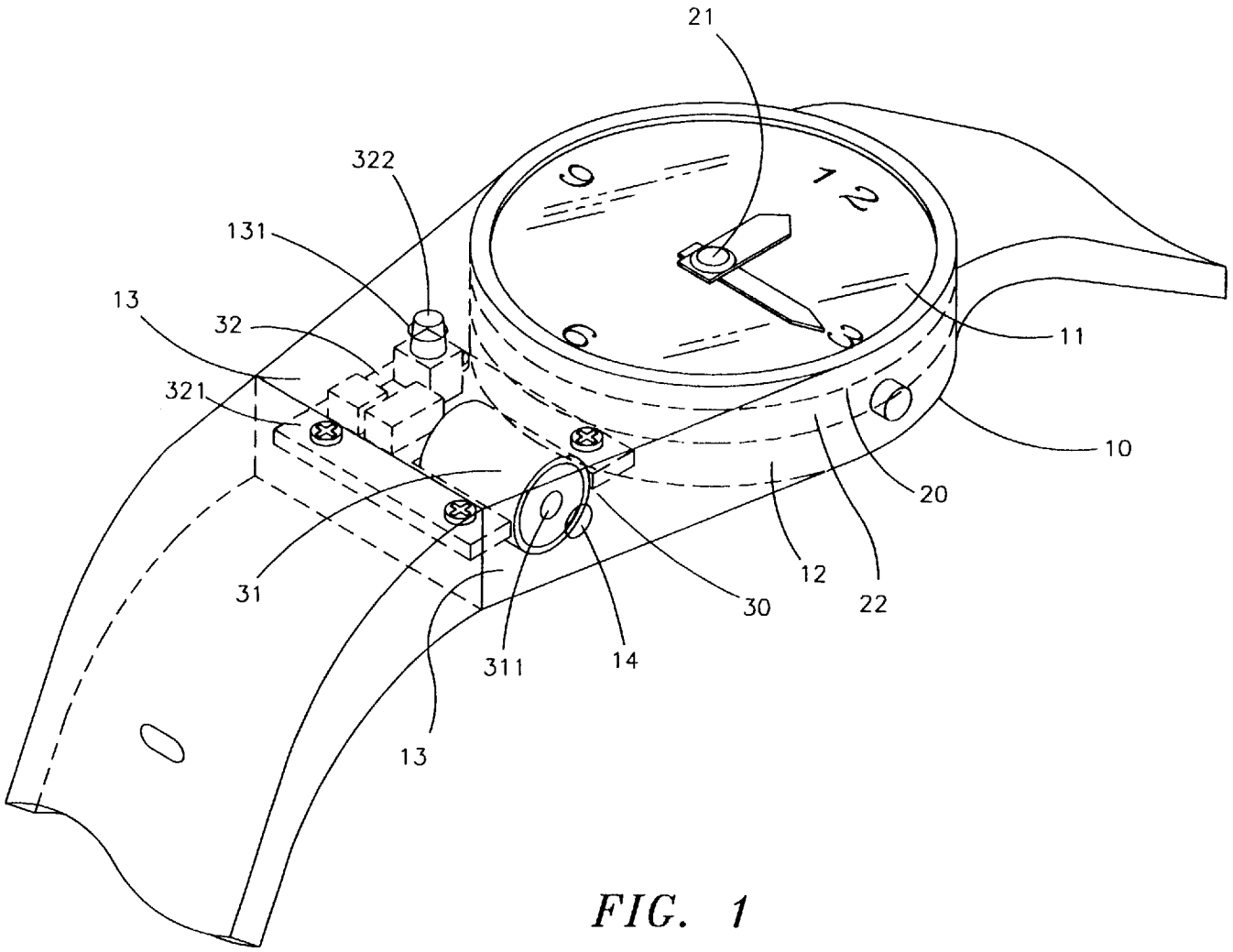
FIG. 1 is a perspective view of the water made according to the present invention.
Figure 2:
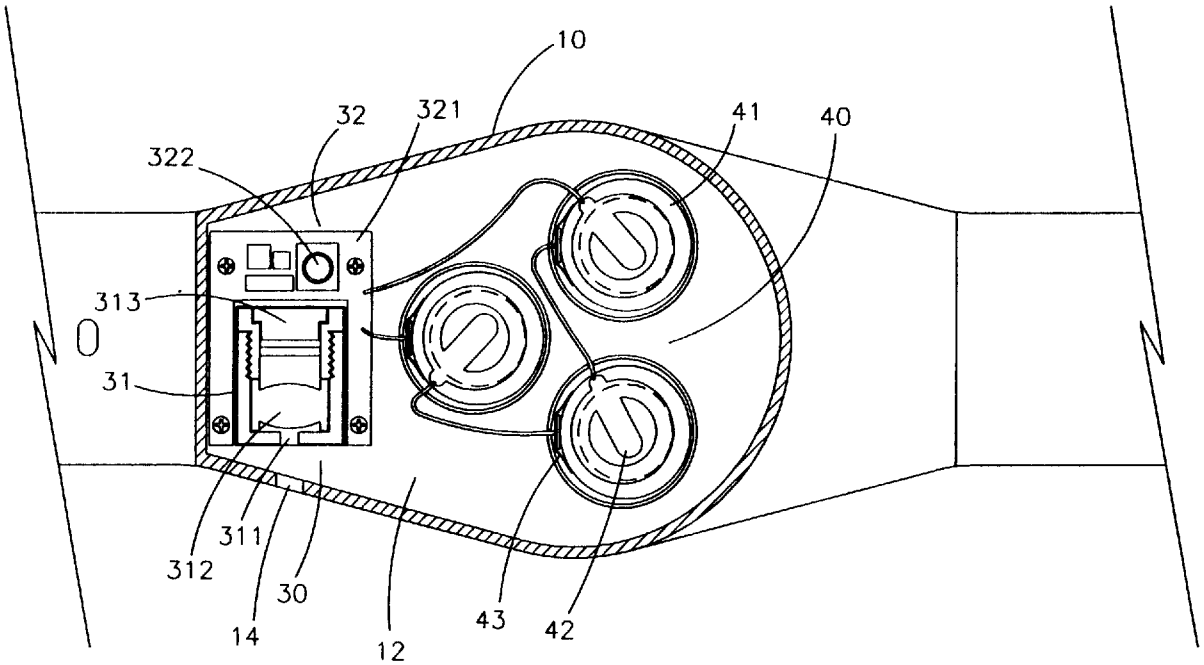
FIG. 2 is a top plan view of he watch made according to the present invention.
Figure 3:
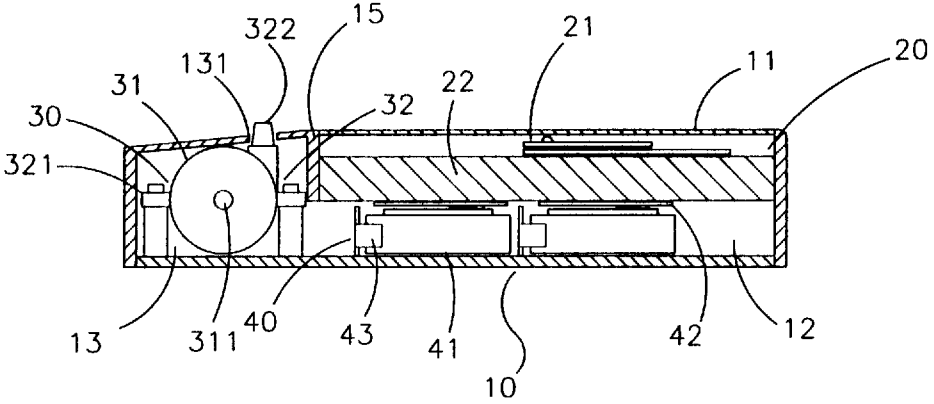
FIG. 3 is a side elevational view of the watch made according to the present invention.

Referring to FIG. 1, the watch has a conventional configuration as the existing watch. Referring to FIGS. 2 and 3, the watch made according to the present invention comprises a housing 10, a modulating core 20, a laser diode module 30, a power supply 40. Those components will be detailed described as follow.

The housing 10 has a general configuration as the conventional one. For example, it has a round, square or polygonal shape, . . . etc. The housing 10 has a clear cover 11 defining a receiving cell 12 therein. The modulating core 20 and the power supply 40 are fixedly received within the receiving cell 12. A partitioning wall 15 is provided and a second receiving cell 13 is defined and which is fixedly disposed with a laser diode module 30 and a power supply 40. The housing 10 is provided with an button opening 131 atop of the second cell 13. The button opening 131 is corresponding to a button switch 322 of the circuit 32 of the laser diode module 30. The top of the button switch 322 is projected over the cover 11 of the housing 10. The housing 10 is further provided with a light aperture 14 which is aligned with the hole 311 of the light source 31. As a result, the laser beam may emit therefrom.

The modulating core 20 can be a mechanic or digital mechanism suitable for counting time. The modulating core 20 is provided with a display 21 for time displaying. The modulating body 22 is disposed beneath the display 21. The modulating core 20 is disposed within the first receiving cell 12 of the housing 10.

A laser diode module 30 includes a light source 31 and a circuitry 32. The light source 31 has a cylindrical housing and is provided with a transparent aperture 311 atop. A convex lens 312 is disposed beneath the aperture 311. The cylindrical housing further includes a laser diode 313 under the convex lens 312. The laser diode 313 is electrically connected to a printed circuit board 321 and which is provided with a button switch 322 which is used to switch on/off the laser diode 313 for a marking pointer.

The power supply 40 is used to supply the power required for normal operation of both the modulating core 20 and the laser diode 30. The power supply 40 is configured by at least one or more batteries 41. Each of the receiving cell is provided with a positive conductor 42 and a negative conductor 43 and which are electrically connected to the input of the modulating core 20 and the laser diode module 30.

Figure 4:
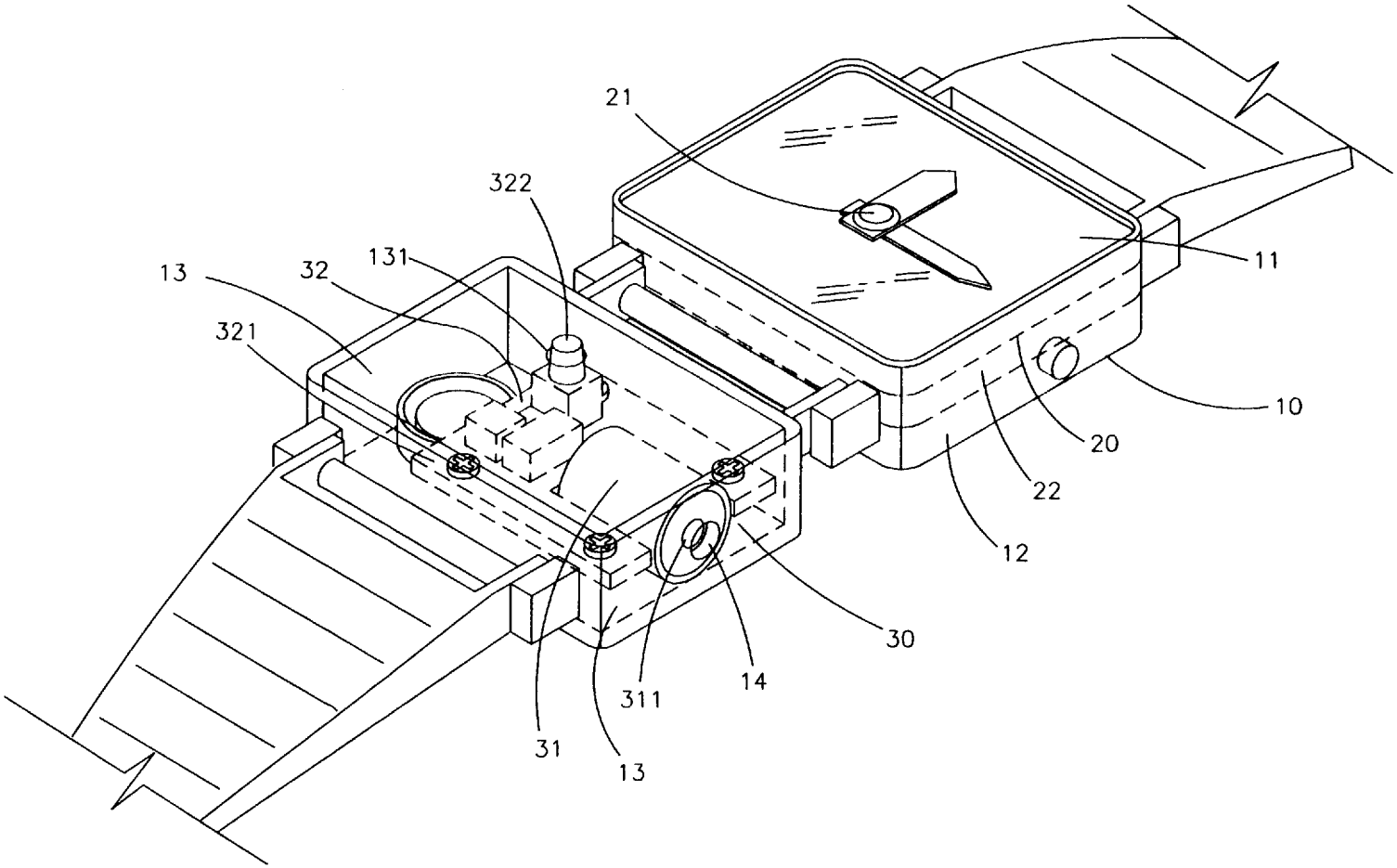
FIG. 4 is a perspective view of another embodiment of the watch made according to the present invention.
Figure 5:
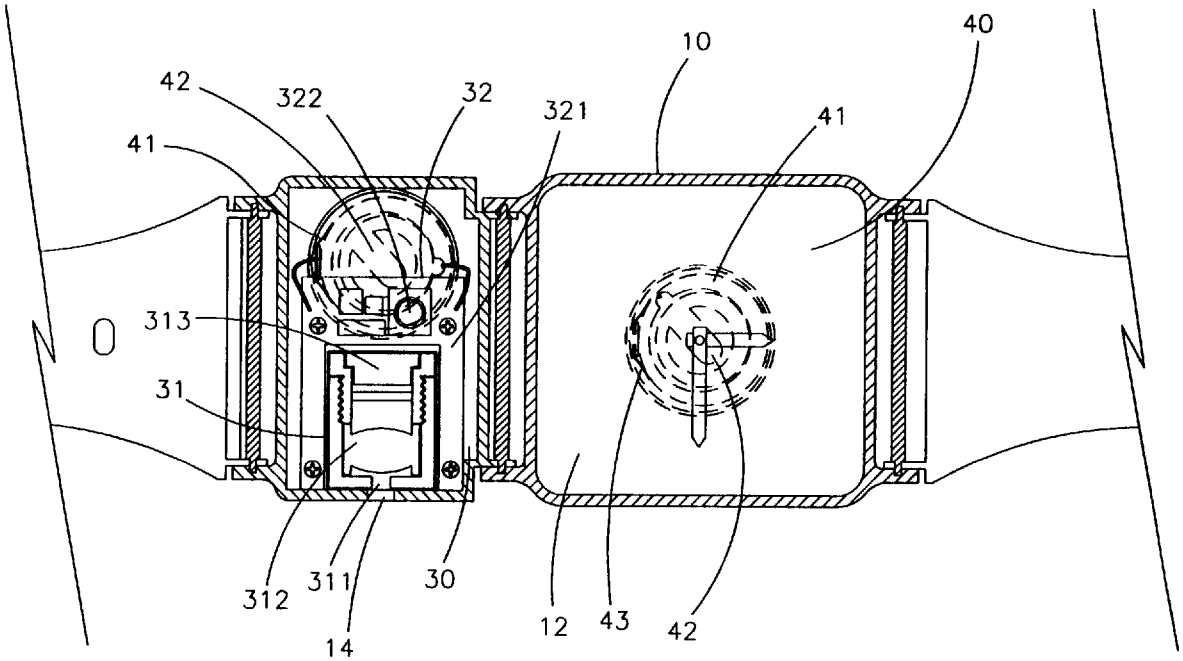
FIG. 5 is a cross sectional view of the watch shown in FIG. 4.

Referring to FIGS. 4 and 5, a preferred embodiment of the water made according to the present invention is disclosed. In this preferred embodiment, the laser diode module 30 is extended to the watchband for readily manipulating by the user. In this variant, the housing 10 is divided into two by the partitioning portion 15. The modulating core 20 is directly installed within the housing 10 and the laser diode module 30 is received within the housing 10'. On the other hand, the power supply 40 is disposed directly under the receiving space under the housings 10, 10' to supply the power required for the normal operation of the modulating core 20 and the laser diode module 30.

Furthermore, when the laser diode module 30 is to be used as a marking pointer, the button switch 322 projected over the housing 10 can be conveniently depressed such that the laser diode module 30 can be powered through the circuitry 321. As a result, when the laser diode module 30 is powered, a laser beam will be emitted from the laser diode 30. This emitted beam is further focused by the convex lens 312 and this intensified beam is further emitted from the aperture 311 disposed in the front of the light source 31 and the light aperture 14 of the housing 10. As a result, the light spot can be used to mark the location in which the audiences need to pat attention. If the user does not need to use it, the watch may serve as a watch for time displaying.

By this arrangement, the watch having a laser pointer may readily serve as a useful tool during the demonstration because it can readily switch on to point out the emphasized highlight or switch off which not in use. The user may readily carry it all around without occupying space or forget it.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A watch having a laser pointer, comprising a housing having a clear cover defining a first receiving cell therein, a modulating core being disposed within said receiving cell, a partitioning portion being disposed at one side and a second receiving space having a laser diode module disposed therein, a power supply being fixedly disposed thereunder, said cover of said housing being provided with an button opening atop of the second receiving cell, said button opening being corresponding to a button switch of a circuit of said laser diode module, the top of said button switch being projected over said cover of said housing, said housing being provided with a light aperture which is aligned with a hole of a light source;

a modulating core having a time display being received within said housing, said modulating core including a modulating body disposed beneath said display, said modulating core being disposed at the peripheral of said laser diode module;

a laser diode module being configured by a light source and a circuitry, said light source having a cylindrical housing and being provided with a transparent aperture atop, a convex lens being disposed beneath said aperture, said cylindrical housing further including a laser diode under said convex lens, said laser diode being electrically connected to a printed circuit board and which is provided with a button switch; and a power supply being configured by at least one or more batteries, each of the receiving cell being provided with a positive conductor and a negative conductor and which are electrically connected to the input of said modulating core and said laser diode module.

2. A watch having laser pointer as recited in claim 1, wherein said housing being divided into a first and second receiving cells by means of a partitioning, said modulating core and said power supply being disposed within said first receiving cell and said laser diode module and said power supply being received within said second receiving cell.

3. A watch having laser pointer as recited in claim 1, wherein said second receiving cell being disposed external of said housing and which is directly disposed at the watchband such that said laser diode module can be independently manipulated.

* * * * *